US005779652A

United States Patent [19]

Mencher-Aliazzo

[11] Patent Number: 5,779,652

[45] Date of Patent: Jul. 14, 1998

[54] ACUPRESSURE AND MASSAGING METHOD

[76] Inventor: Bonnie Mencher-Aliazzo, 6 Fiddlers Green Spur, Huntington, N.Y. 11743

[21] Appl. No.: 767,601

[22] Filed: Dec. 12, 1996

[51] Int. Cl.[6] ..... A61H 11/00; A61H 15/00

[52] U.S. Cl. ..... 601/132; 601/128; 601/131

[58] Field of Search ..... 601/118, 119, 601/124, 125, 128, 129, 131, 132, 143, 147, 122, 123

[56] References Cited

U.S. PATENT DOCUMENTS

| | | | |
|---|---|---|---|
| 932,780 | 8/1909 | Hero | 601/132 |
| 1,657,974 | 1/1928 | Scoggin | 601/129 |
| 1,702,991 | 2/1929 | Bechmann | 601/132 |
| 5,577,996 | 11/1996 | Gardner et al. | 601/129 |

FOREIGN PATENT DOCUMENTS

| | | | |
|---|---|---|---|
| 79558 | 2/1895 | Germany | 601/132 |
| 2323851 | 11/1974 | Germany | 601/132 |
| 2725869 | 4/1978 | Germany | 601/128 |
| 26682 | 11/1912 | United Kingdom | 601/132 |

*Primary Examiner*—Danton D. DeMille
*Attorney, Agent, or Firm*—Alexander Mencher

[57] ABSTRACT

A unitary and configurative acupressure and massaging device and system for detecting and treating muscular irregularities and injuries, comprised of a plurality of resilient and compressive balls slidably mounted on and between the ends of an elongate and flexible fibrous component functioning as a ball carrier, and against which device a user's body weight is applied when the body is either at rest or in motion.

1 Claim, 3 Drawing Sheets

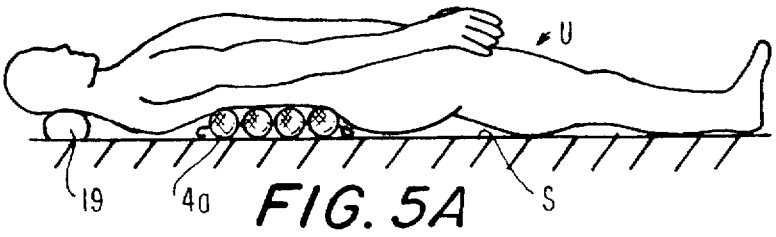
FIG. 5A
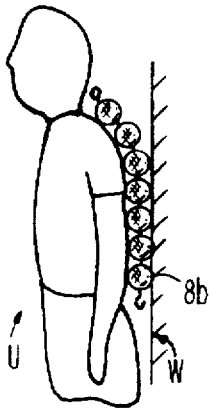
FIG. 5B
FIG. 6A
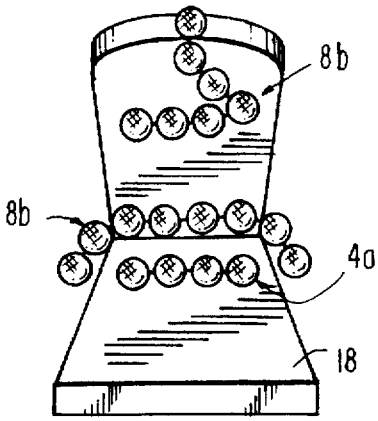
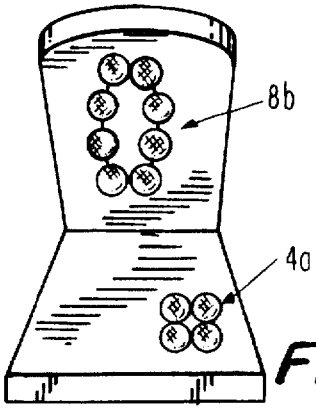
FIG. 6C
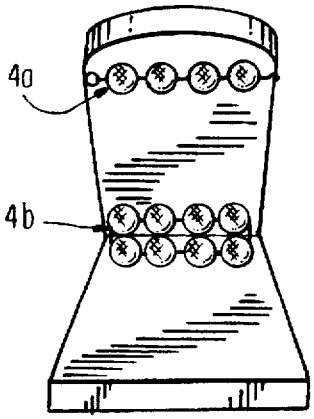
FIG. 6B
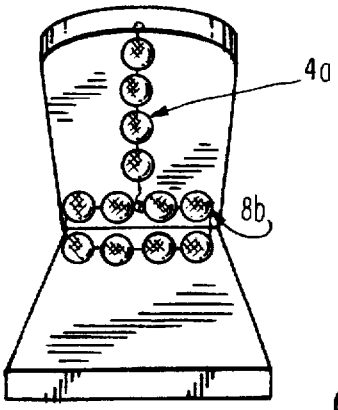
FIG. 6D
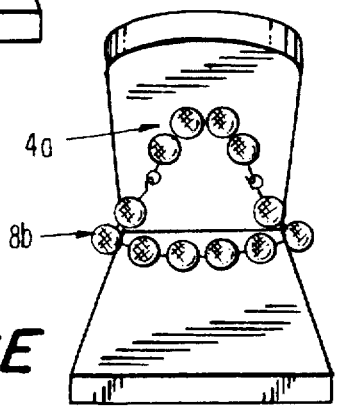
FIG. 6E

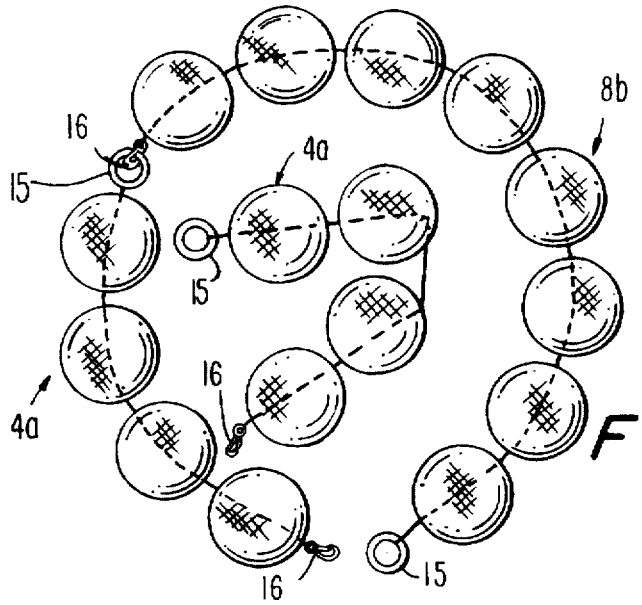
FIG. 7
FIG. 8A
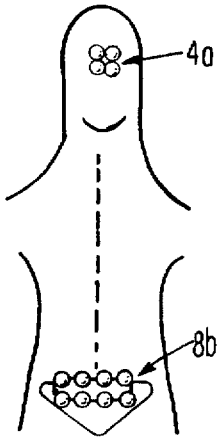
FIG. 8B
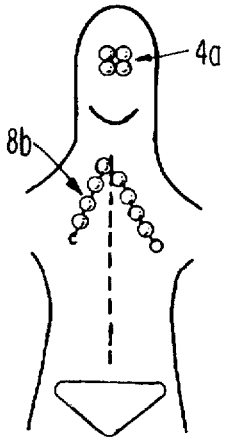
FIG. 8C
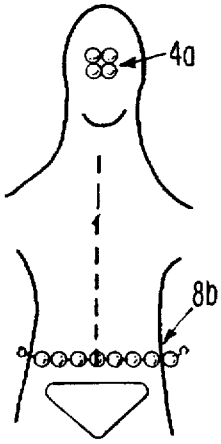
FIG. 8D
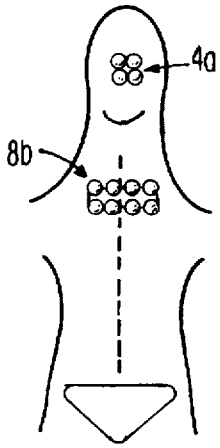
FIG. 8E
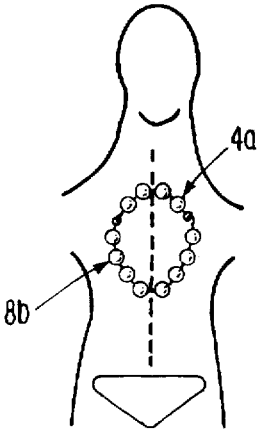
FIG. 8F
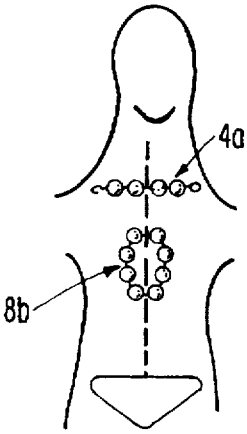
FIG. 8G
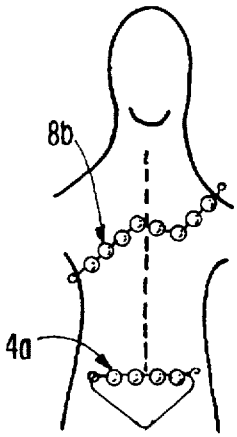
FIG. 8H
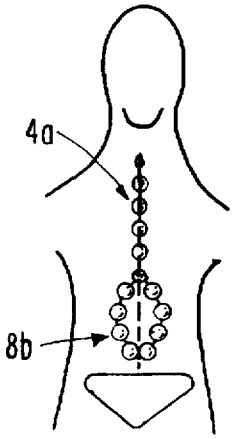

ACUPRESSURE AND MASSAGING METHOD

BACKGROUND OF THE INVENTION

The invention relates generally to self-applied acupressure and massaging devices and systems for detection and treatment of muscular irregularities, pain and injuries. More specifically, it relates to novel improvements in surface-supporting devices having balls and ball carriers which, when in use, requires the user to lie, press and move thereagainst and in various positions for device functioning.

The main objective of the invention is to simplify, make more functional and wieldable, safe, more efficient and less expensive the structure of ball carriers. Pertinent devices as exemplified in the prior art are U.S. Pat. No. 4,233,966 to George K. Takahashi, 1989; U.S. Pat. No. 4,796,616 to Yousef Panapour, 1989; and U.S. Pat. No. 4,974,582 to Gary C. Johnson, 1990.

In contrast to such prior art, the invention provides a carrier characterized by an elongate, fibrous, flexible element which provides a slidable and configurative string mounting for the balls of the device.

Thus, Takahashi as a carrier for knobs used in the practice of the art of acupressure utilizes a rigid platform with distributed openings for knob mounting. The user places himself or herself on the device so that the knobs or simulated fingers apply therapeutic pressure to the desired areas.

Panapour, deemed the closest of prior art cited, uses as a carrier for resilient, yieldable and movable balls in the practice of the art of massage, a pair of large, opposed, rigid, and spaced connected plates with opposite and aligned openings for ball mounting and rotational movement.

Johnson for the mounting of acupressure protuberances or balls utilizes a pair of spaced panels of fabric between which the balls are releasably secured.

Other objects and features of the invention include the provision of a unitary and configurative device which has a minimum number of parts, and which is less cumbersome, more compact and flexible, and foldable for ease of portability, packaging and storage.

These objects and other incidental ends and advantages of the invention will hereinafter appear in the progress of this specification and as pointed out in the appended claims.

SUMMARY OF THE INVENTION

The invention embraces a unitary and configurative acupressure and massaging device and system for detecting and treating muscular irregularities, pains and injuries. It comprises in assembly a plurality or series of similar resilient and compressive spherical balls slidably mounted on and between the ends of an elongate and flexible element such as a strong twine of appropriate denier. Each of the twine or string terminals is provided with restraint and engagable means to perform several functions, such as to prevent separation of the balls from the carrier; to enable releasable engagement for closure of the developed unit; and to releasably couple units for expanding the area of application of the device to the body of the user.

Operation of the device involves a choice in configuration of a geometric and planar pattern suitable to the needs of the user. Such pattern is spread on a relatively flat supporting surface such as a carpeted floor, bed, seat or wall and against which the body weight or pressure of the user is applied for two consecutive operations. The first is to effect an acupressure function, and the second is diagnostic, namely, to determine rearrangement of ball positioning for freedom of movement, if necessary, such movement being under body control for massage operation.

BRIEF DESCRIPTION OF THE DRAWINGS

Accompanying this specification are drawings showing a preferred form of the invention wherein:

FIG. 5A is a perspective and diagrammatic view of a user lying supinely on and supported by underlying units.

FIG. 5B is a perspective and diagrammatic view of a user standing vertically with the back of the anatomy pressing against an eight-ball unit in vertical alignment and wedged against a wall.

FIGS. 6A–6E are reference charts of various possible positions and configurations in units of the invention, and as applied to a seat and back rest to encompass pressure and other points of the anatomy subject to treatment.

FIG. 7 is a detail of an enlarged and circular configuration of four-ball and eight-ball units coupled in series and an internal and open 4-ball unit to encompass a large area of the back of the anatomy for ball concentration.

FIGS. 8A–8H are reference charts of various positions and configurations in geometric patterns of units of the invention as applied to the back of the user's anatomy to encompass pressure and other points subject to treatment.

DETAILED DESCRIPTION OF THE INVENTION

Figure 3:
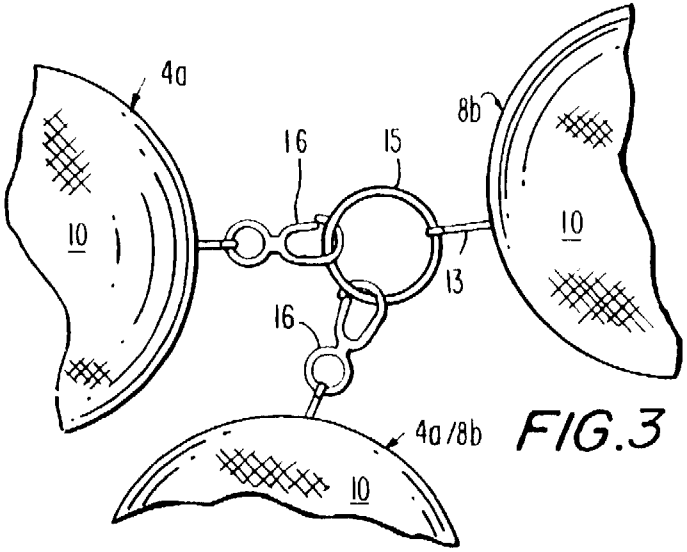
FIG. 3 is fan enlarged detail of several units with parts broken-away, and representing both series and parallel coupling of units.

The invention and the preferred form shown in the accompanying drawings relate to an acupressure and massage apparatus for detection and treatment of common muscular ailments, irregularities, pain, spasms, injuries and other conditions. As illustrated, it is comprised of at least one unit of a series of adjacent, similar, elastic, resilient, spherical, and hollow balls of appropriate dimensions and strength slidably mounted on a flexible carrier. In such assemblage, the unit is adapted to be surface-supporting as on a carpeted surface or floor, bed, seat or wall.

The device is constructed to support a user's body, body part, weight, pressure, and movement. Acupressure treatment is accomplished by user's body or body part resting on or exerting varying pressure against the device, as for example, while lying in supine position. Implemental massage treatment is accomplished whenever necessary or desired by adding body or body part movements to engage and control ball movements in all directions. In this event, the balls of the unit involved must have freedom of motion and be out of contact with adjacent balls for user to obtain a smooth and soothing therapeutic effect. Such effect is in simulation of human finger operation.

Four- and eight-ball units 4*a* and 8*b* are preferable in number of balls to the unit. These sizes accommodate average dimensions of a user for both independent and combined use in coupled formation. With respect to numbers of balls possible for concentrated body application, reference is made to FIG. 7 showing 16 balls and in FIG. 4B showing an exaggerated number. With respect to two-ball units (not shown in the drawings), the carrier string as hereafter delineated should have an increased slack length to permit wider spacing of the two balls within the dimensional confines of the user's back. In contrast thereto and for purposes of foot and leg treatment of the user, the two balls may be smoothly slid together on the carrier string to afford a broader area of treatment. For reasons of wieldability, units should not be in excess of ten balls.

Figure 4A:
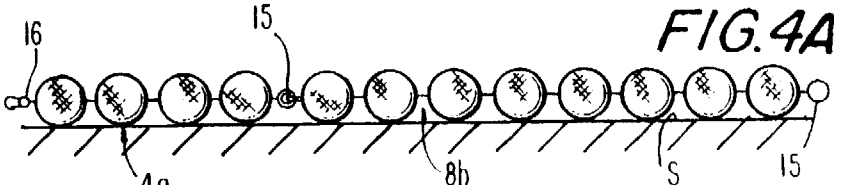
FIG. 4A is a diagrammatic view in elevation showing a unit of four and a unit of eight balls coupled together and spread in spaced and horizontal alignment.
Figure 4B:
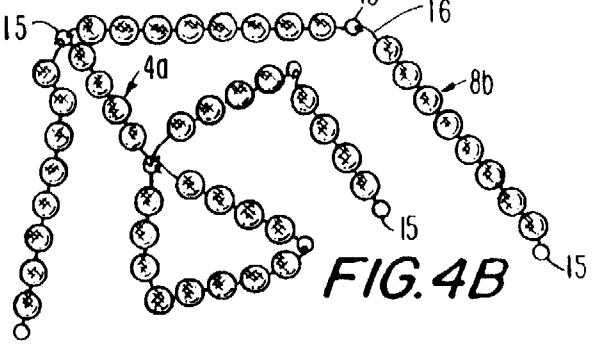
FIG. 4B is a diagrammatic view of a configuration of several four-ball and eight-ball units coupled both in series and in parallel for large and local area coverage of the back of the anatomy.
Figure 4C:
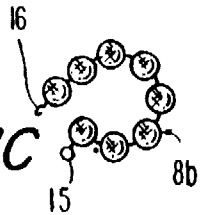
FIG. 4C is a diagrammatic view of a circular geometric configuration of an eight-ball unit of the invention.
Figure 4D:
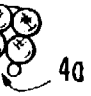
FIG. 4D is a diagrammatic view of a square geometric configuration of a four-ball unit of the invention.
Figure 1:
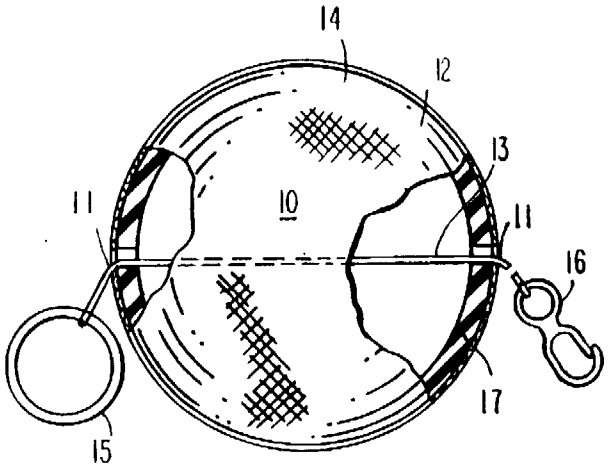
FIG. 1 is an enlarged diagrammatic detail of one end ball of a unit of the invention, showing parts broken-away, omitted and foreshortened.
Figure 2:
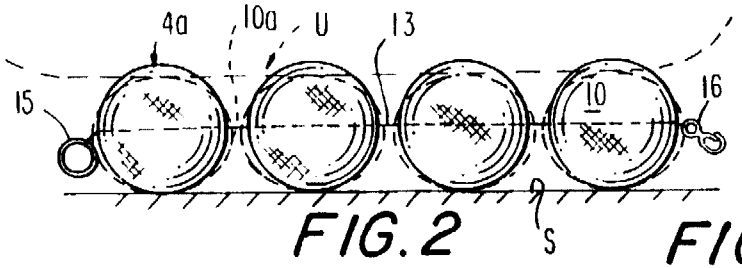
FIG. 2 is a diagrammatic view in elevation representing a slight flattening of balls in a unit of the invention, with a user supinely lying thereon in phantom.

Detailed and definitive structure of a typical unit of either a four- or eight-ball arrangement is best seen in FIGS. 1, 2, and 4A. Ball 10 as preferred and found to be most desirable in size and physical properties, is about two and one-half inches in outer diameter, having a surface skin 12 and an optional soft covering or felt 14. Such covering lends itself to ball washability. Ball 10, preferably formed of rubber, in addition to being hollow, resilient and compressive on application of force, is further provided with a pair of opposite and diametric perforations or apertures 11. Wall thickness 17 for strength and proper resiliency is approximately one-eighth of an inch. Availability of balls for production —such as tennis balls —is well known.

In conjunction with balls 10 and assemblage therewith is an elongate and flexible carrier element 13 to serve as a smooth and slidable mounting therefor. Length of carrier 13 for a four-ball unit 4*a* is approximately eleven and one-half inches, and includes a slack length of one and one-half inches to allow for device flexibility and positional spacing of balls. Such flexibility of the device and spacing of balls for freedom of ball mobility will be explained hereafter under the caption of Mode of Operation. The length of carrier 13 for an eight-ball unit 8*b* is about twentythree inches and also further includes a slack length of about three inches for similar purposes as applied to unit 4*a*.

The first and second terminals or ends of carrier 13 for each of the units 4*a* and 8*b* are each provided with restraint means such as ring member 15 and eyeletted releasable hook member 16 to serve as elements to prevent the end balls of the unit from becoming separated from the ball carrier. Such components also provide engagable elements as hook and ring members at the carrier terminals for closure of open units of the device and for coupling of units, all as best illustrated in FIG. 1 and FIG. 3. Are Carrier 13 as a major point of novelty of the invention is an elongate and flexible member necessarily of strong composition to withstand the dynamics of the device. In the preferred form, it may be characterized as a pre-waxed and three-ply polyester twine of a denier and strength as measured from a quantity of four ounces in weight, 510 feet in length and a 40 pound test for tensile strength. This type of string is manufactured and available from Consolidated Thread Mills of Fall River, Massachusetts.

FIGS. 4B, 4C and 4D, 5A and 5B, 6A–6E, 7, and 8A–8H are views and diagrams of geometric designs of the device and their applications to embrace and include various parts of the body, and over pressure and other points known best to those versed in the arts of acupressure and massage. Normally inaccessible regions are easily reached thereby. Respecting FIGS. 4B, 4C, 4D and 7, single and coupled units are shown in open formation, namely, with the terminal's eyeletted ring and eyeletted hook members 15 and 16 in disengaged relationship. FIG. 5A is a diagram of a user U lying supinely on a four-ball unit 4*a* as seen in elevation on a floor surface S for self acupressure and massage treatment. In this view, the user is provided with a pillow 19 for head support and balance. In FIG. 8B, cervical and head support for treatment is illustrated. In FIG. 5B, the user is standing vertically with his back wedging a unit 8*b* against wall W, also for self acupressure and massage treatment. Here, the device is used while user is in lightwear clothing. In FIG. 5A, the diagram shows the user without clothes, but it is preferable for the body to be covered to avoid possible skin abrasions and discomfort.

With respect to FIGS. 6A–6E, a seat and back rest 18 are shown with single and coupled units 4*a* and 8*b* applied. These figures indicate body parts subject to acupressure and massage treatment for the occupant, whether at home, during athletic activities, business and travel.

With respect to FIGS. 8A–8D, disposition of units 4*a* and 8*b* is illustrated on schematics of the rear of the body, including the head and back regions.

As described, units 4*a* and 8*b* are comprised of an appropriate length of string as carrier 13, balls 10, and restraint and coupling means such as ring and eye letted hook members 15 and 16. Production and assemblage follow standard practice. Perforations 11 in balls 10, threading thereof with string 13, and attachment of string terminal restraint and engaging members 15 and 16 are steps also performed by conventional means and operations.

Mode of Operation

The unitary device functioning either as a single or a plurality of coupled units is adapted to be spread over a substantially rigid surface S such as a carpeted floor, bed, chair 18 or wall W in a geometric pattern preselected by user U as from charts in FIGS. 8A–8H, charts in FIGS. 6A–6E and charts in FIGS. 5A and 5B. The user then eases his or her body against the outspread pattern whether supinely as against surface S as illustrated in FIGS. 2 and 5A, against a seat 18 and backwise as illustrated in FIGS. 6A–6E, and against a wall W as illustrated in FIG. 5B.

Resting the body against the device as stated produces an acupressure treatment for muscular stimulation, circulation, relaxation and detection of troubled spots. If such spots are detected and further implemental treatment of massage is required, this is accomplished by body's movement and varying pressures with concentration over such areas. Thus, the device provides a twofold function, acupressure and massage with appropriate body movement. For acupressure purposes, weight, and if desired, body force is directed to balls 10 of the unit underlying the troubled spot. By body engagement with such ball or balls and thereby controlling and causing rolling thereof with the appropriate body movements, a massaging operation is produced with all the therapeutic advantages afforded by this line of therapy. A synchronization in movements between body and balls occurs.

Treatment may be continued as long as required or desired. However, if the effective balls become jammed by contact with other adjacent balls or for any other reason, a frictional resistance may be felt with body movement. In such event, experimentation becomes necessary. The user then resorts to manipulating the balls at the troubled areas until freedom of ball-rolling movement in all directions is effected —or the unit is flexed for different design formation and further manipulated for proper ball positioning.

While using the device of this invention, untroubled areas are also embraced and receive treatment and exercise. It is also worth noting that when ring and hook components 15 and 16 are in disengaged relationship in a unit, the geometric pattern may be in the form of a loose open loop. When in engagement, the pattern is in the form of a closed and substantially tight loop due to the lack of slack in carrier element 13. Closed loop formations in four—and eight-ball units 4*a* and 8*b* are seen in FIGS. 8A–8D.

Briefly stated, the invention can be reduced to practice by exercising three simple steps: (1) spreading the device to a selected pattern on a supporting surface for application to the back of the user; (2) having the user lie supinely either at rest or under exertion of body force on the device to enable both general application of acupressure treatment and detection of troubled areas; and (3) adapting the configuration and positioning of balls for one of two reasons. The first reason is to change the pattern of choice while in supine position if a different pattern is sought to be more desirable for acupressure treatment. The second reasaon is to give the contacting balls under the detected trouble spots more freedom of motion for ball rollability in all directions, thereby to enable subsequent massage treatment.

Performance of above operations with the device as described enables ball movements, both under detected areas and under control of and in synchronization with appropriate body movements, to transform self-applied massage treatments of present art to a smooth, pleasant, rolling and therapeutic experience. The slight flattening of balls 10, when supported thereon, and as shown at 10*a* in FIG. 2, does not interfere in any functional manner with the freedom of ball movement.

It should be further understood that the drawings, mode of operation and description of the invention are illustrative and explanatory, and that various changes and modifications in structure and procedure may be resorted to without departing from the spirit of the invention and the scope of the appended claims.

I claim:

1. A method for detection and treatment of muscular irregularities of the back of the human body utilizing a configurative and flexible acupressure and massaging device, comprised of a row of balls slidably, spatially and adjustably mounted on a flexible, elongate and inelastic string for freedom of limited motion in all directions, and wherein the balls are compressive, hollow and resilient, comprising the steps of:

(a) selecting a design of pressure points on the back of the human body that conforms to and embraces the areas requiring treatment;

(b) spreading the device over a supporting surface and adjusting the balls thereof spatially along the string and in a shape following the selected design so as to embrace areas requiring treatment;

(c) applying the back of the body against the device as spread out for engagement with the balls; and (d) oscillating the body supported by the balls to control corresponding movement of the balls in all directions and in unison.

* * * * *